US006634765B2

(12) United States Patent
Lin

(10) Patent No.: US 6,634,765 B2
(45) Date of Patent: Oct. 21, 2003

(54) LIGHT STRIP BENDABLE TO FORM VARIOUS PATTERN

(76) Inventor: Chien-Yao Lin, P.O. Box No. 6-57, Chung Ho, Taipei 235 (TW)

( * ) Notice: Subject to any disclaimer, the term of this patent is extended or adjusted under 35 U.S.C. 154(b) by 13 days.

(21) Appl. No.: 09/996,726

(22) Filed: Nov. 30, 2001

(65) Prior Publication Data

US 2003/0103349 A1 Jun. 5, 2003

(51) Int. Cl.[7] ..... F21V 21/00

(52) U.S. Cl. ..... 362/249; 362/391; 362/806; 362/252; 362/800

(58) Field of Search ..... 362/249, 391, 362/806, 252, 800, 123

(56) References Cited

U.S. PATENT DOCUMENTS 3,894,225 A * 7/1975 Chao ..... 362/249
4,482,944 A * 11/1984 Roossine et al. ..... 362/418
4,667,276 A * 5/1987 Cheng ..... 362/249
4,761,720 A * 8/1988 Solow ..... 362/252
5,155,669 A * 10/1992 Yamuro ..... 362/252
5,410,459 A * 4/1995 Yang ..... 362/249
5,746,500 A * 5/1998 Chien ..... 362/103
5,769,533 A * 6/1998 Yamuro et al. ..... 362/249
5,834,901 A * 11/1998 Shen ..... 315/185 S
5,931,577 A * 8/1999 Ishibashi ..... 362/249
2001/0043472 A1 * 11/2001 Gibboney ..... 362/240

* cited by examiner

*Primary Examiner*—Sandra O'Shea
*Assistant Examiner*—Ali Alavi
(74) *Attorney, Agent, or Firm*—Troxell Law Office PLLC

(57) ABSTRACT

A light strip bendable to form various figures having a control line or a guide wire circuit tandem connected by a plurality of light source bodies connecting with a fixing bar to form various patterns. The fixing bar includes a plurality of parallel forming bars with a layer of thin film having a plurality of through holes disposed inbetween to connect two forming bars. The light source guide wires and the control line are disposed in the lower aspect of the thin film. The light source bodies penetrate the through holes. The fixing bars and the thin film cover twist around the control lines. At least one flexible metal form wire with a proper diameter is disposed inside the guide wire, the forming bar or the control line to make the present invention formable.

3 Claims, 9 Drawing Sheets

LIGHT STRIP BENDABLE TO FORM VARIOUS PATTERN

BACKGROUND OF THE INVENTION

1) Field of the Invention

The present invention provides a light strip bendable to form various pattern, more especially a light strip capable of being immediately formed after being bent; the features of the present invention include that the structure thereof is not only tightly sealed to proof the water and the electric leakage, but also a sturdy light strip suitable to be applied on advertisement bulletin board, to decorate a meeting area, to be bent into brilliant writing figures or patterns for decoration.

2) Description of the Prior Art

Accordingly, various styles of writing words or figures made (or tandem connected) by luminous bodies are very attention catching, colorful and bright; therefore, they are often used to decorate common commercial products, meeting areas and advertisement captions; the conventional luminous body structures can be approximately divided into two kinds, one is the so called neon light with many color glass light tubes; however, the disadvantages thereof includes that it is a product of high voltage and needs a structural facility for very strict protection; more particularly, the glass light tube subjects to crack after being bumped, it might result in danger and the price is quite high.

Another kind of conventional light product is a felxible light tandem connected by a plurality of miniature light bulbs; the structure thereof comprises a plurality of twisted (or, in other case, extruded and molded plastic) strands of electric wires tandem connected with a plurality of light bulbs to be used for hanging on a Christmas tree or interior decoration; however, one of its shortcomings is that the interval spaced between the light bulbs thereof is too long to have more lights; in addition, the entire light string is a flexible body or is molded by extrusion; its another shortcoming is that it will drop arcuately due to the force of gravity and other clamping tools are required for fastening; furthermore, when the tandem connected electric wire drop downwardly under the weight of the light bulbs, it is not easy to firmly clamp or hold it to form preferred circular arch body, the wring words or patterns.

SUMMARY OF THE INVENTION

The primary objective of the present invention is to use a control line or a plurality of tandem connected light source bodies to join with a fixing bar for forming; wherein the fixing bar include a plurality of parallelly conductive forming bars with a layer of thin film disposed inbetween to connect two forming bars; wherein the position of the central axis of at least one or two forming bars is inserted by a flexible forming wire; a plurality of through holes are disposed on the thin film; the light source bodies and the control line are disposed in the lower aspect of the thin film; the light source bodies penetrate the through holes; two fixing bars tightly press against each other; the said thin film covers the control line; two fixing bars twist into a screwy structure; a plurality of protecting cover bodies respectively cover every light source body and the entire light holders on the control line to form an electric leakage-proof and waterproof light string in various styles.

To enable a further understanding of the structural features and the technical contents, the brief description of the drawings below is followed by the detailed description of the preferred embodiment.

DETAILED DESCRIPTION OF THE PREFERRED EMBODIMENTS

Figure 1:
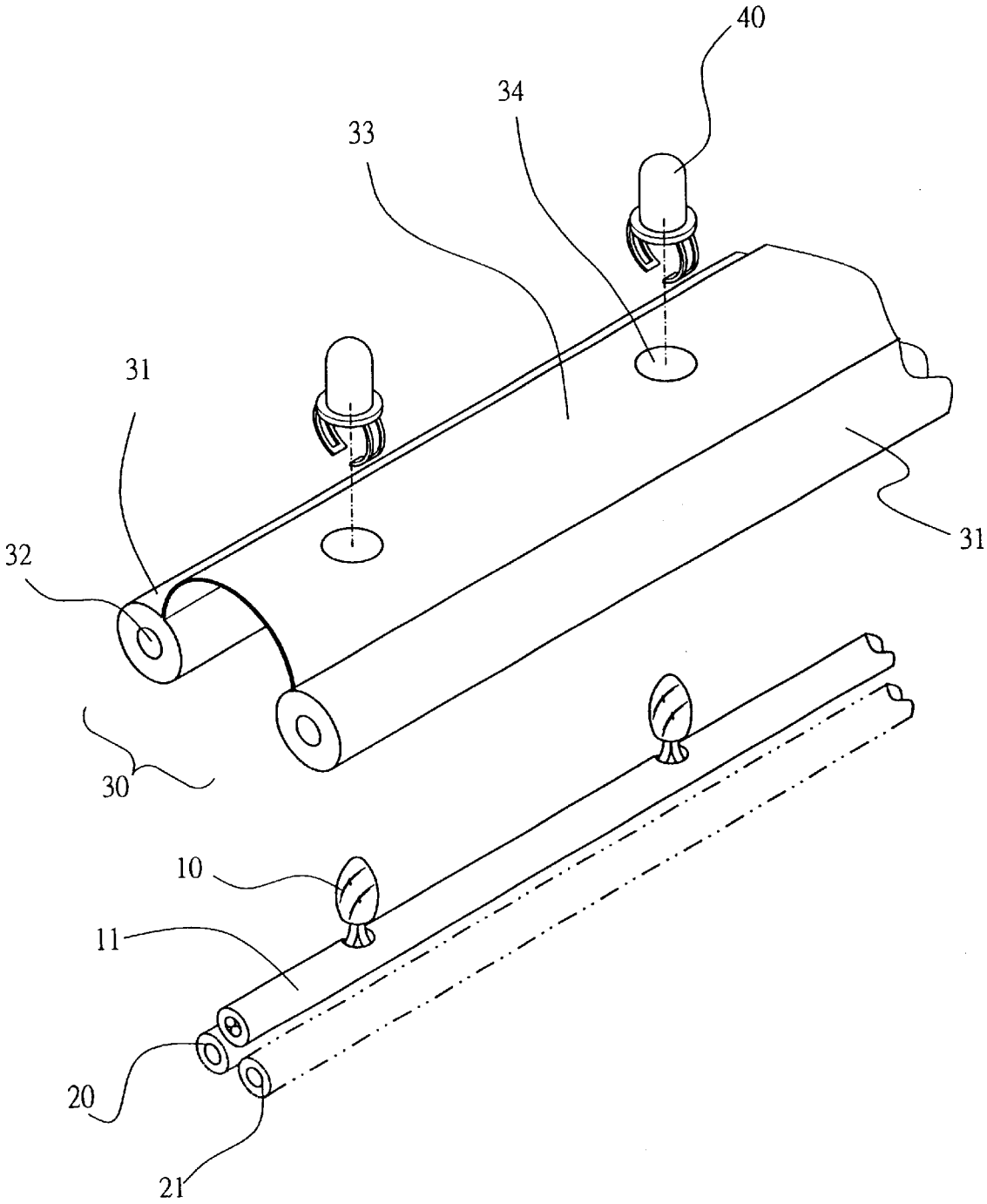
FIG. 1 is an exploded drawing of the structure of the present invention.
Figure 2:
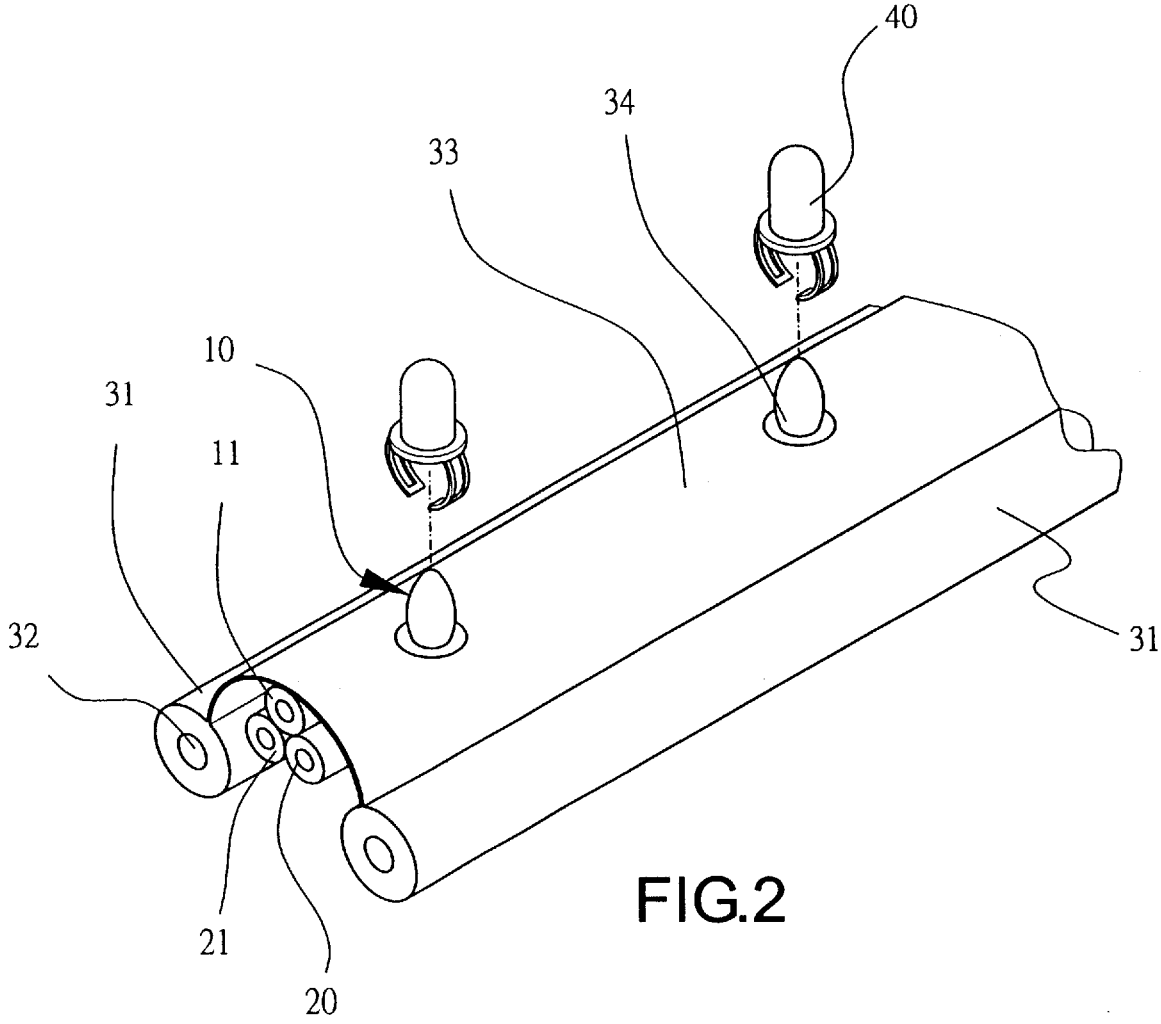
FIG. 2 is a schematic drawing of the assembled present invention.
Figure 13:
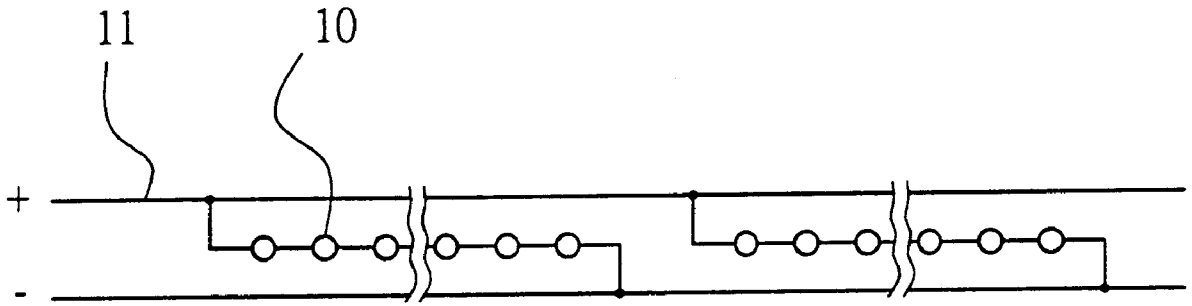
FIG. 13 is a schematic drawing of one kind of circuits of the present invention.
Figure 14:
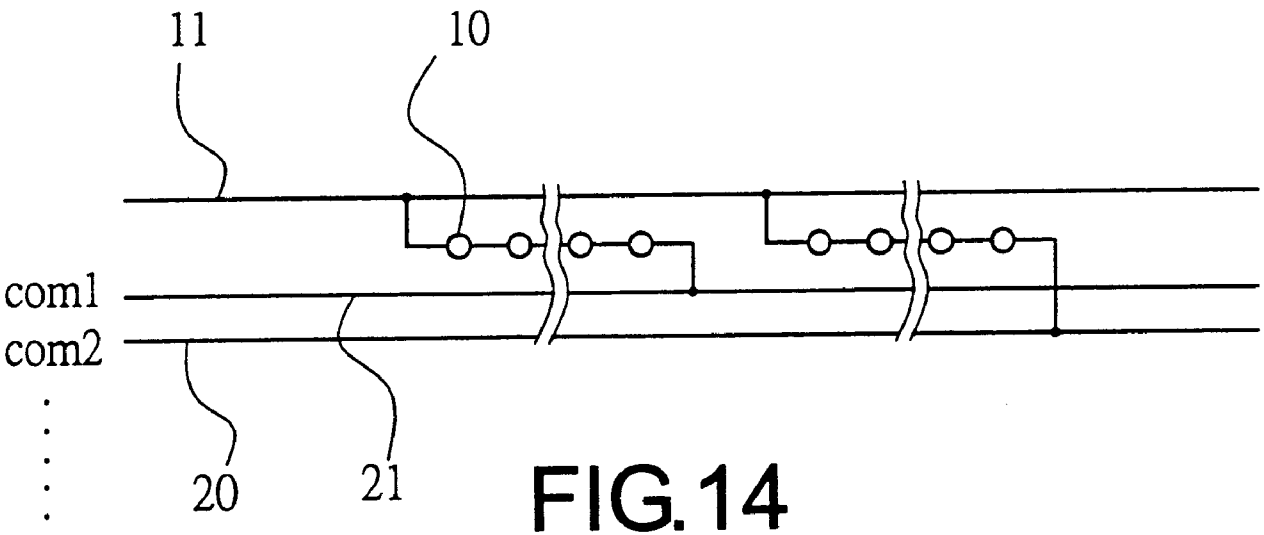
FIG. 14 is a schematic drawing of another kind of circuits of the present invention.

Referring to FIGS. 1 and 2, the present invention mainly comprises one or two control lines (20, 21) or a guide wire (11) assembled with a plurality of light source bodies (10) to form a circuit for controlling lighting; the method of controlling the light source body (10), as shown in FIGS. 13 and 14, is capable of making variations of different on/off twinkling patterns (accordingly, this on/off lighting pattern is a prior art and not be described here), wherein, the said light source bodies (10);can be miniature light bulbs or luminous liquid-emitting diode (LED) bodies; a special conductive fixing bar (30) is disposed to engage with the guide wire (11) with light source bodies (10) and the control lines (20, 21); the features thereof are that the said conductive fixing bar (30) includes two or more than two parallel forming bars (31); a layer of thin film (33) is connected between the forming bars (31); at least one flexible forming wire (32) is inserted at the center of the forming bar (31); the said flexible forming wire (32) can be a metal wire of a proper width (usually with a diameter longer than 0.3 mm); a plurality of through holes (34) are disposed on the thin film (33).

Figure 3:
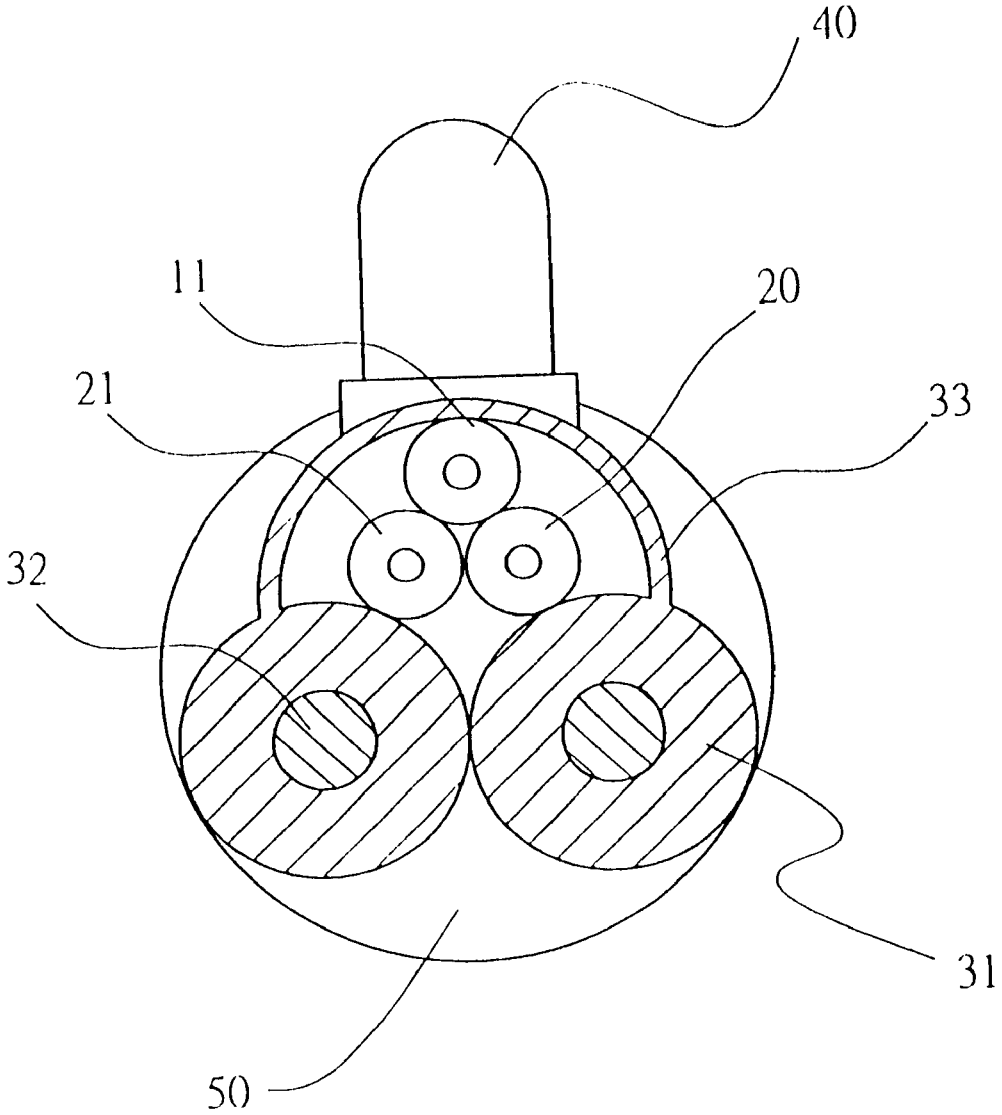
FIG. 3 is a cross-sectional and structural drawing of the present invention added by a protective cover body.
Figure 8:
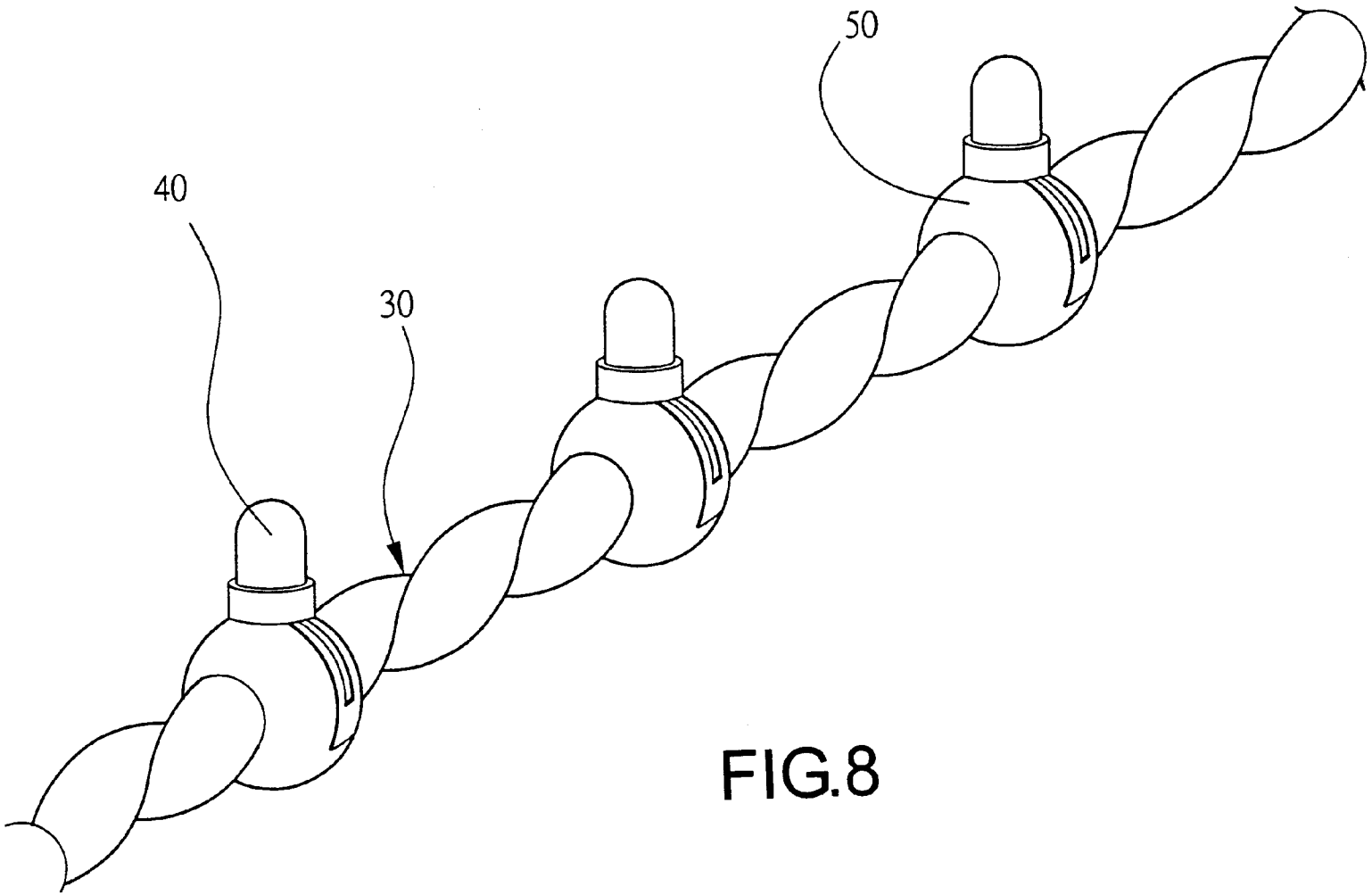
FIG. 8 is a pictorial drawing of the assembled protective cover body of the present invention.

Referring to FIGS. 1, 2 and 3, the guide wire (11) with the light source bodies (10) and the control lines (20, 21) are disposed in the lower aspect of the thin film (33); the light source bodies (10) penetrate the through holes (34); the fixing bars (30) press inwardly and tightly against each other; the fixing bars (30), referring to FIG. 8, are twisted screwy structures; the thin film (33) tightly covers the guide wire (11) and the control lines (20, 21).

Referring to FIGS. 3 and 8, a plurality of protective cover bodies (40) respectively cover on each light source body (10); in addition, the said area is formed into a plastic forming block (50) to cover the entire light holders on the control line (20) to achieve the objectives of proofing the water and the electric leakage.

Figure 4:
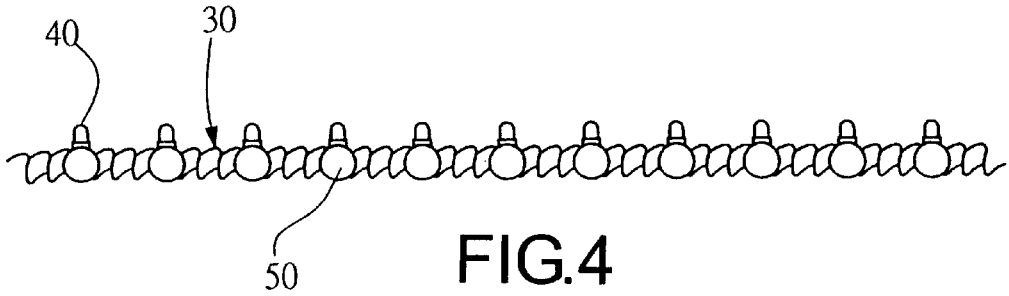
FIG. 4 is the first drawing of the exemplary embodiment of the twisted structure of the present invention.
Figure 5:
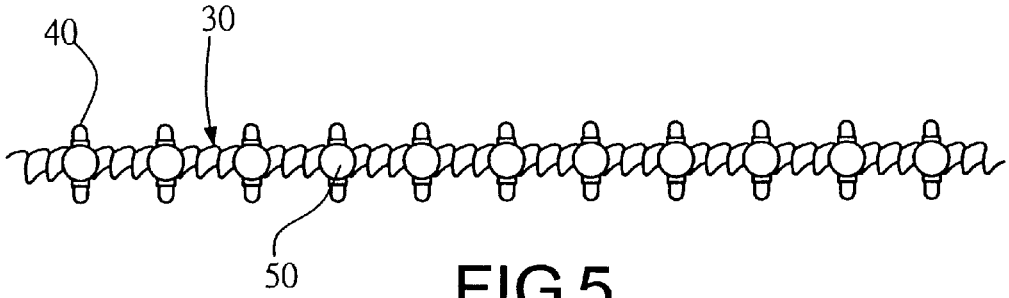
FIG. 5 is the second drawing of the exemplary embodiment of the twisted structure of the present invention.
Figure 6:
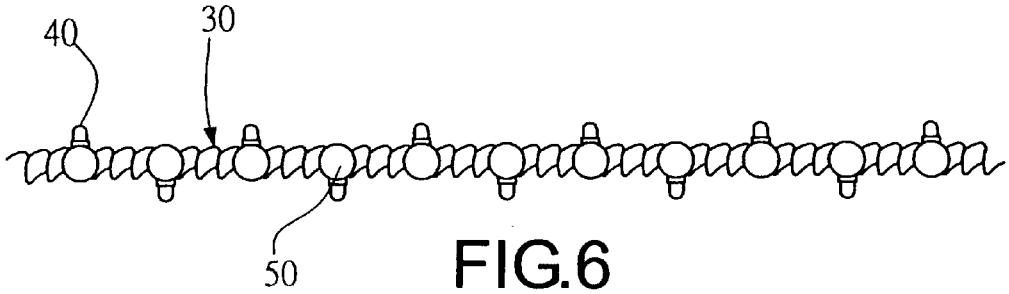
FIG. 6 is the third drawing of the exemplary embodiment of the twisted structure of the present invention.
Figure 7:
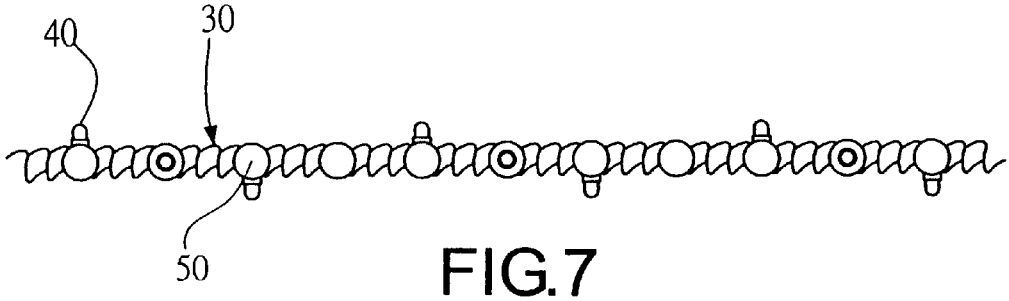
FIG. 7 is the forth drawing of the exemplary embodiment of the twisted structure of the present invention.

As shown in FIG. 2, two fixing bars (30) twist in a screwy way and the light source bodies are arranged variously inbetween; for example, as shown FIG. 4, the light source body (10) is located on one side of the present invention in a straight line spaced in an equal interval; or, as shown in FIG. 5, all of the light source bodies (10) can be arranged oppositely up-and-down and spaced in an equal interval; or, as shown in FIG. 6, all o the light source bodies (10) can be staggered up-and-down in a straight line; or, as shown FIG. 7, all of the light source bodies can bias at an uncertain angle along with the rotary angle of the forming bars (30) allowing the light source bodies (10) of the present invention to have different arrangements on the fixing bars (30) so as to provide pleasant aesthetic sense.

Figure 9:
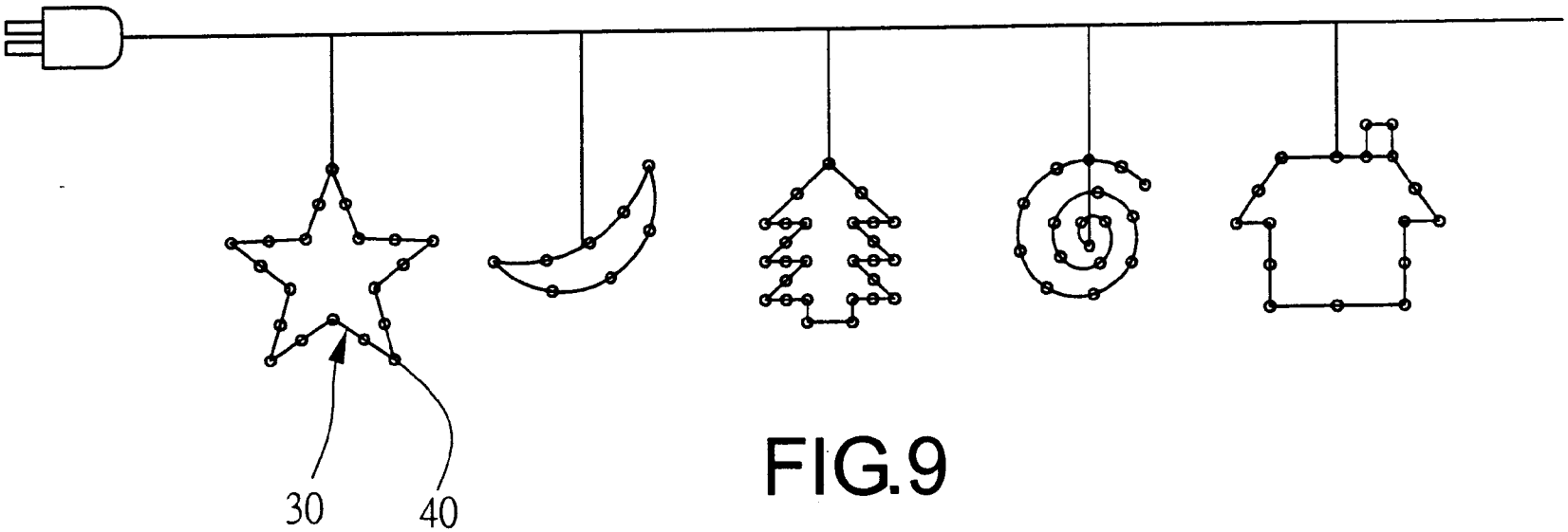
FIG. 9 is an exemplary embodiment of the applied figures of the present invention.

Referring to FIG. 9, the present invention can be bent to form the shapes of a star, a crescent, a cute tree, a geometric figure, a letter and a numeral pattern; it is then connected in parallel with the lines to obtain a delicate, cute, pleasant and creative light strip.

The abovementioned is only a preferred embodiment; in an actual application, the central axis of the said guide wire (11) or the control lines (20, 21) can be a single and thicker metal wire; the center of the fixing bar (30) can be a plurality of strands of common thin copper wires or a single and thick copper wire; apparently, they are within the scope of the present invention.

Figure 10:
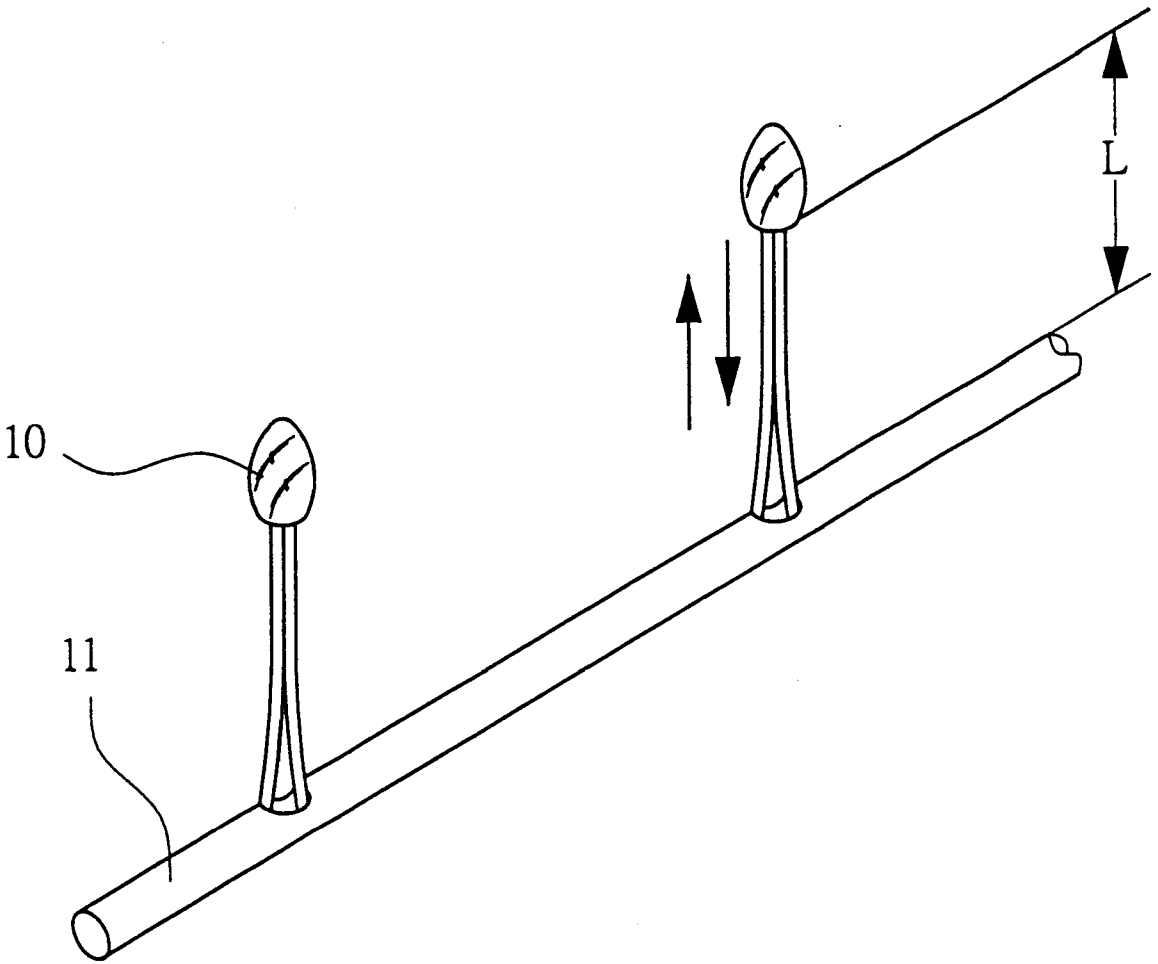
FIG. 10 is a structural drawing of the guide wire of the present invention.
Figure 11:
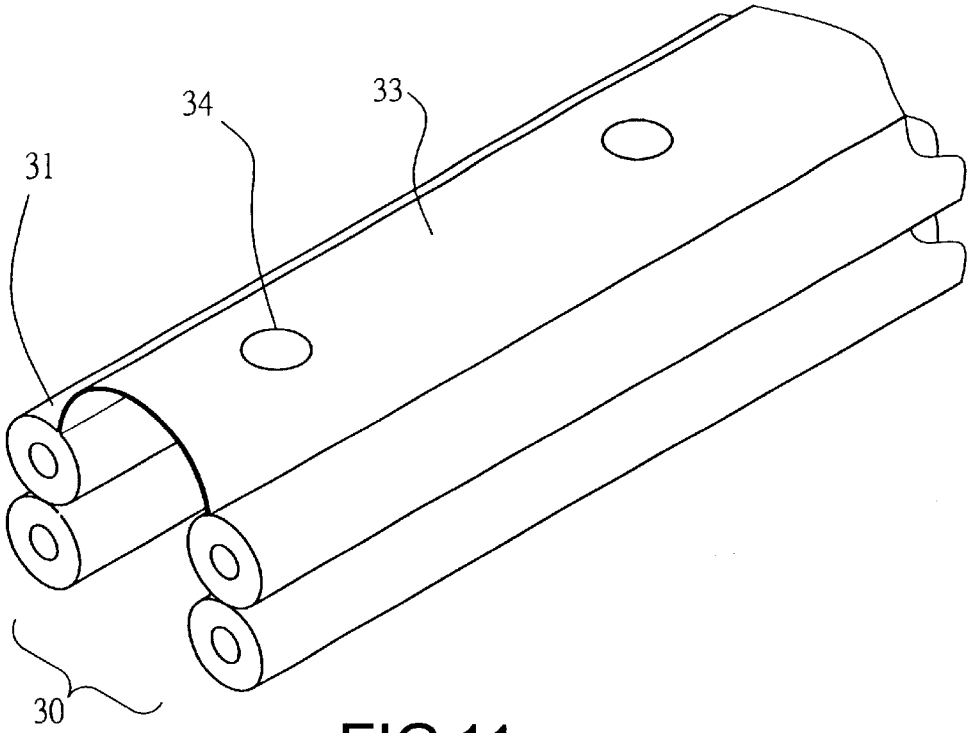
FIG. 11 is a structural drawing of another exemplary embodiment of the forming bars of the present invention.
Figure 12:
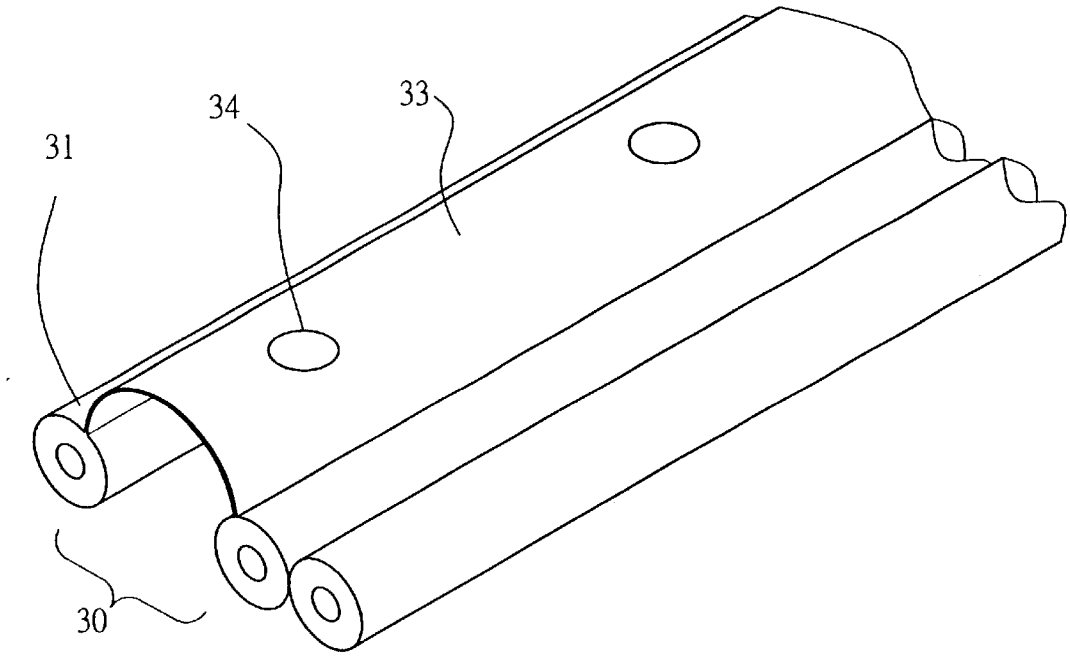
FIG. 12 is also a structural drawing of another exemplary embodiment of the forming bars of the present invention.

Referring to FIG. 10, in the tandem connected light source bodies (10), the projected distance (L) of the guide wire (11) of the present invention can be adjusted for twisting into various figures; as shown in FIGS. 11 and 12, the number of the forming bar (31) in the fixing bar (30) of the present invention can be plural; a plurality of forming bars (31) can be connected on the right and the left sides or on a single side thereof in an exemplary variation; that is also within the scope of the present invention.

Since the present invention possesses special ideas, it has the following advantages in application:

1. The present invention has two (or a plurality of) fixing bars with flexible forming bars disposed respectively therein; it can be bent to form any kind of shape to fully extend the creative space and brilliantly lighted shapes without requiring any externally added clamping tool and that is the most excellent feature and advantage of the present invention.
2. The light source body of the present invention is covered inside the protective cover body; the control lines are rotatorily covered between two fixing bars and a layer of thin film; therefore the engagement force is very strong and the structure does not crack to cause danger; that is another advantage of the present invention.
3. The present invention itself is a lineal structure of a strip of luminous and bendable body that can be bent directly and accordingly to any desired shape; the shape is specific and easy to be alternated; no matter the lineal shape is bent into a circular arch or at different angles, the shape is quite specific and does not subject to deviate; that is another advantage of the present invention.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A light strip bendable to form various figures comprising: a control line connected to a guide wire with a plurality of light source bodies engaging with a fixing bar;

the fixing bar includes a plurality of parallelly conductive forming bars and a layer of thin film connecting the plurality of forming bars; the thin film, having a plurality of through holes;

the guide wire with a plurality of light source bodies and the control line are connected to the thin film; the light source bodies penetrate the through holes;

the forming bars tightly press against each other; the thin film covers the control line; the forming bars twist into a screw structure; a plurality of protecting cover bodies respectively cover every light source body and the entire light holders on the control line to form a forming block; and at least one of the plurality of forming bars includes a flexible metal forming wire such that the present invention is formable.

2. The light strip bendable to form various figures according to claim 1, wherein the a light source body is selected from a group consisting of a miniature light bulb and a light emitting diode (LED) body.

3. The light strip bendable to form various figures according to claim 1, wherein the flexible forming wire is a metal wire with a diameter greater than 0.3 mm.

* * * * *